US008075462B1

(12) United States Patent
Hinds et al.

(10) Patent No.: US 8,075,462 B1
(45) Date of Patent: Dec. 13, 2011

(54) ELASTIC MEMBER EXERCISE DEVICE

(75) Inventors: Robert S. Hinds, Madison, WI (US); Glenn Polinsky, Waunakee, WI (US)

(73) Assignee: Robert S. Hinds, Madison, WI (US)

( * ) Notice: Subject to any disclaimer, the term of this patent is extended or adjusted under 35 U.S.C. 154(b) by 0 days.

(21) Appl. No.: 13/016,177

(22) Filed: Jan. 28, 2011

Related U.S. Application Data

(60) Provisional application No. 61/299,032, filed on Jan. 28, 2010.

(51) Int. Cl.
*A63B 21/02* (2006.01)

(52) U.S. Cl. ..... 482/125; 482/126

(58) Field of Classification Search ..... 482/122, 482/124, 125, 126, 139, 148; 24/300
See application file for complete search history.

(56) References Cited

U.S. PATENT DOCUMENTS

| | | | | |
|---|---|---|---|---|
| 3,256,015 | A | 6/1966 | Perrin | |
| 4,026,549 | A | 5/1977 | Gunn | |
| 4,059,265 | A | 11/1977 | Wieder et al. | |
| D263,613 | S | 3/1982 | Henry | |
| 4,375,886 | A | 3/1983 | Muys | |
| 4,563,002 | A | 1/1986 | Jardine | |
| 4,733,862 | A | 3/1988 | Miller | |
| 4,779,867 | A | 10/1988 | Hinds | |
| 5,549,532 | A * | 8/1996 | Kropp | 482/126 |
| 5,713,821 | A * | 2/1998 | Nissen | 482/114 |
| 5,873,805 | A * | 2/1999 | Ayres et al. | 482/125 |
| 5,894,631 | A * | 4/1999 | Chiu | 16/110.1 |
| 6,398,698 | B1 | 6/2002 | Hinds | |
| 6,497,641 | B1 | 12/2002 | Hinds | |
| 6,663,544 | B2 | 12/2003 | Hinds | |
| 6,672,997 | B1 | 1/2004 | Winkler | |
| 6,692,415 | B1 * | 2/2004 | Winston | 482/126 |
| 7,044,896 | B2 | 5/2006 | Hetrick | |
| 7,090,622 | B2 | 8/2006 | Hetrick | |
| 7,147,592 | B2 | 12/2006 | Hinds et al. | |
| 7,316,636 | B1 * | 1/2008 | Hinds et al. | 482/126 |
| 7,578,775 | B2 * | 8/2009 | Terry | 482/126 |
| 7,651,448 | B2 | 1/2010 | Hetrick | |
| 7,722,508 | B2 | 5/2010 | Hetrick | |
| 2004/0009858 | A1 * | 1/2004 | Tamaribuchi | 482/139 |
| 2006/0063652 | A1 * | 3/2006 | Berman et al. | 482/139 |
| 2006/0105893 | A1 | 5/2006 | Chen | |
| 2007/0015643 | A1 * | 1/2007 | Kung | 482/126 |
| 2007/0027005 | A1 | 2/2007 | Hetrick | |
| 2007/0066450 | A1 | 3/2007 | Hetrick | |
| 2007/0117694 | A1 | 5/2007 | Fitzmaurice | |
| 2007/0207904 | A1 * | 9/2007 | Wu | 482/126 |

(Continued)

*Primary Examiner* — Allana Lewin
(74) *Attorney, Agent, or Firm* — Craig A. Fieschko, Esq.; DeWitt Ross & Stevens S.C.

(57) ABSTRACT

An exemplary exercise device includes a foot cuff and a hand grip separated by an elastic member. Rigid and flexible foot cuff sections define a foot passage for a foot. A foot cuff body passage in the rigid foot cuff section receives a foot cuff pivot having an enlarged portion and a plug. The plug is inserted in an elastic member socket, and is able to point in different directions as the enlarged portion pivots within the foot cuff body passage. The hand grip includes a hand grip channel for replaceably receiving the elastic member, which is removably secured to the hand grip using an impinger or by being wrapped about the hand grip and inserted in a groove. A user can insert a foot through the foot passage and grip the hand grip, stretching the elastic member between the foot and hand while walking, performing calisthenics, etc.

29 Claims, 6 Drawing Sheets

U.S. PATENT DOCUMENTS

| | | | | |
|---|---|---|---|---|
| 2007/0254786 | A1 | 11/2007 | Owen | |
| 2009/0075787 | A1 | 3/2009 | Hetrick | |
| 2009/0075788 | A1 | 3/2009 | Hetrick | |
| 2009/0075789 | A1 | 3/2009 | Hetrick | |
| 2009/0075790 | A1 | 3/2009 | Hetrick | |
| 2009/0075794 | A1 | 3/2009 | Hetrick | |
| 2009/0105053 | A1 | 4/2009 | Hetrick | |
| 2009/0215593 | A1* | 8/2009 | Ligrano et al. | 482/124 |
| 2010/0292055 | A1* | 11/2010 | Andrich | 482/122 |
| 2011/0160023 | A1 | 6/2011 | Murphy | |

* cited by examiner

ELASTIC MEMBER EXERCISE DEVICE

CROSS-REFERENCE TO RELATED APPLICATIONS

This application claims priority under 35 USC §119(e) to U.S. Provisional Patent Application 61/299,032 filed Jan. 28, 2010, the entirety of which is incorporated by reference herein.

FIELD OF THE INVENTION

This document concerns an invention relating to exercise devices incorporating elastic members.

BACKGROUND OF THE INVENTION

Exercise devices are known which use one or more hand grips, each bearing at least one elastic cord engaged to an anchor point. By varying the elasticity of the elastic cords, the devices can be configured to provide different resistances to stretching. Resistance is experienced by a user when one end of an elastic cord is fixed to an anchor point while the hand grip at the other end is pulled away from the fixed end. The elastic cord may be anchored to an immobilized object such as a wall, floor, or door frame, or the elastic cord may be anchored to a part of the user's body. Elastic cords that provide such resistance can substitute for weights, and in general the greater the resistance of an elastic cord, the greater the maximum weight that can be simulated.

Elastic cords may, over time, wear and break. Elastic cords become particularly vulnerable to wear and breakage at their points of attachment to exercise components because of the greater strain at this area. As such, what is needed is a way of attaching elastic cords to exercise devices that imposes less strain on the elastic cords, making them less susceptible to wear and breakage.

Separately, an exercise hand grip incorporating a particular elastic cord is limited to providing the stretch resistance resulting from its particular elastic cord. If an operator would like to simulate three different weights, for example, the operator traditionally must obtain three different exercise devices that incorporate three different elastic cords, each elastic cord having a different elasticity. Replacing exercise hand grips each time a different resistance is desired is costly. What is needed is an exercise hand grip that permits the operator to conveniently replace the elastic cord to be used without replacing the whole device.

SUMMARY OF THE INVENTION

The invention, which is defined by the claims set forth at the end of this document, is generally directed, among other things, to exercise devices with flexibly pivotal points of attachment for their elastic cords that relieve strain and make the elastic cords less susceptible to breakage. The invention also relates generally to exercise hand grips with handles that permit convenient installation and replacement of elastic cords. The features of this invention can be incorporated into exercise devices individually or in combination. Although some of the figures and diagrams may depict a device that incorporates, for example, both a flexibly pivotal point of attachment as well as a hand grip that permits convenient replacement of elastic cords, these features are independent and thus they need not be combined to provide their respective benefits and advantages.

Referring initially to FIG. 1, an exemplary exercise device 10 includes a foot cuff 20 and a hand grip 30, with an elongated elastic member 40 extending between the two. The elastic member 40 has an elastic member first end 42 removably secured to the foot cuff 20, and an elastic member second end 44 removably secured to the hand grip 30. A user 50 may insert a foot 52 through a foot passage 215 and grip the hand grip 30 with a hand 54, stretching the elastic member 40 between the foot 52 and the hand 54 while walking, jogging, running, performing calisthenics, or other exercises. As shown in FIG. 2A, the foot cuff 20 includes a foot cuff body 200 with a rigid foot cuff section 205 and a flexible foot cuff section 210, the rigid and flexible foot cuff sections 205, 210 defining the foot passage 215 sized to receive the foot 52 (or a shoe) therethrough. Referring to FIG. 4, the hand grip 30 may be elongated to allow for easier gripping with the hand 54, extending from a hand grip top side 305 to an opposing hand grip bottom side 310. The hand grip 30 includes a hand grip channel 315 formed therein, the hand grip channel 315 extending the length of the hand grip 30 and able to receive the elastic member 40 therethrough.

Referring to FIGS. 2A and 2B, a foot cuff body passage 220 is defined in the rigid foot cuff section 205, the foot cuff body passage 220 extending from a foot cuff body inner side 225 to a foot cuff body outer side 230. A foot cuff pivot 235 is pivotally fit in the foot cuff body passage 220, the foot cuff pivot 235 sized such that it cannot pass through the foot cuff body passage 220 at the foot cuff body outer side 230. The foot cuff pivot 235 includes a pivot enlarged portion 240 partly situated within the foot cuff body passage 220, and a pivot plug 245 extending from the pivot enlarged portion 240 away from the foot cuff body inner side 225. The elastic member first end 42, which includes an elastic member socket 46 defined therein, is secured to the foot cuff pivot 235 by inserting the pivot plug 245 into the elastic member socket 46.

Referring to FIG. 5, the hand grip 30 may include a chamber 320 sized to stow at least a portion of the elastic member 40 at the hand grip top side 305. The chamber 320 is preferably situated to receive the elastic member 40 extending from the hand grip channel 315. A closable lid 325 covering the chamber 320 may be situated over the hand grip top side 305, the lid 325 being movable to open and close the chamber 320. The stowed portion of the elastic member 40 is preferably secured within the chamber 320 when the lid 325 is closed. The hand grip 30 may include an impinger 330 secured thereto (e.g., within the chamber 320), the impinger 330 configured to impinge on the elastic member 40 extending through the hand grip channel 315 to secure the elastic member 40 to the hand grip 30. The impinger 330 may be configured to hinge between an engaged position (as shown in FIG. 5) in which the impinger 330 at least partially enters the hand grip channel 315 to impinge on the elastic member 40 extending through the hand grip channel 315, and a disengaged position (not pictured) in which the impinger 330 does not enter the hand grip channel 315.

As an aid to performing push-up or other exercises with the hand grip 30, a bottom side protrusion 340 may extend outward from the hand grip bottom side 310 in a direction that is perpendicular to the long axis of the hand grip 30. With the protrusion 340 pressed against a floor, the user's 50 fingers and knuckles can be distanced from the floor when the user 50 grips the length of the hand grip 30 and performs pushups.

Alternatively or additionally, the hand grip 30 may include an upper flange 605, and a lower flange 610 spaced therefrom, the upper and lower flanges 605, 610 radially extending outward from the hand grip 30 and circumferentially orbiting the hand grip channel 615, as shown in FIG. 6A. The upper and lower flanges 605, 610 are substantially parallel to each other, and situated near the top of the hand grip 30. A hand grip valley 620, also circumferentially orbiting the hand grip 30, is formed in the space between the upper and lower flanges 605, 610. The upper flange 605 has an upper flange inner surface 606 facing the hand grip valley 620, and an opposing upper flange outer surface 607 facing upwards. The lower flange 610 has a lower flange inner surface 611 facing the hand grip valley 620, and an opposing lower flange outer surface 612 facing downwards. As shown in FIG. 6B, the hand grip valley 620, which is sized such that at least a portion of the elastic member 40 fits therein, allows the user 50 to feed the elastic member 40 through the channel 615 wrap an unused portion of the elastic member 40 around the hand grip 30. To help secure the elastic member 40 to the hand grip 30, the hand grip 30 includes a groove 630 that is sized to receive the elastic member 40 and restrict its movement therethrough. The groove 630 may be in the upper flange 605 (as shown), extending between the upper flange outer surface 607 and the upper flange inner surface 606, and/or the lower flange 610 (not pictured), extending between the lower flange inner surface 611 and the lower flange outer surface 612. The groove 630 opens onto the hand grip valley 620 so that the elastic member 40 can extend from the hand grip valley 620 and into the groove 630.

An exemplary method of using the exercise device 10 may include feeding the elastic member through the hand grip channel 315, 615 and adjusting the position of the elastic member 40 to a desired position (i.e., to a desired unstretched separation between the foot cuff 20 and the hand grip 30). A first portion of the elastic member 40 may be wrapped around the hand grip channel 315 within the hand grip valley 620, and the elastic member 40 may be locked in the desired position by installing the elastic member 40 within the groove 630 (see FIGS. 6A and 6B) or by engaging the impinger 330 (see FIG. 5). With a foot 52 inserted in the foot passage 215, and a hand 54 holding the hand grip 30, the user 50 can expend energy to stretch the elastic member 40 between the foot 52 and the hand 54 as the user 50 walks, jogs, or performs other exercises.

The exercise device 10 is highly portable and easy to use, allowing the user 50 to enhance workout routines. The user 50 works his or her muscles by repeatedly stretching the elastic member 40 between the foot 52 and the hand 54. The foot cuff pivot 235 allows the elastic member 40 to rotate and easily change position relative to the hand grip 30, decreasing wear-and-tear and strain on the elastic member 40 and thus extending its life. The foot passage 215 lets the user 50 quickly insert and remove his or her foot 52. Elastic members 40 are easily replaceable by removing the pivot plug 245 from the elastic member socket 46 and inserting the pivot plug 245 into another elastic member 40 (which may have a different resistance and/or length). The hand grip 30 allows easy adjustment and storage of portions of the elastic member 40, letting users 50 of differing height, arm swing, gait, etc., incorporate elastic members 40 of varying length and resistance into the exercise device 10.

Further advantages and features of the invention will be apparent from the remainder of this document in conjunction with the associated drawings.

DETAILED DESCRIPTION OF PREFERRED VERSIONS OF THE INVENTION

Figure 1:
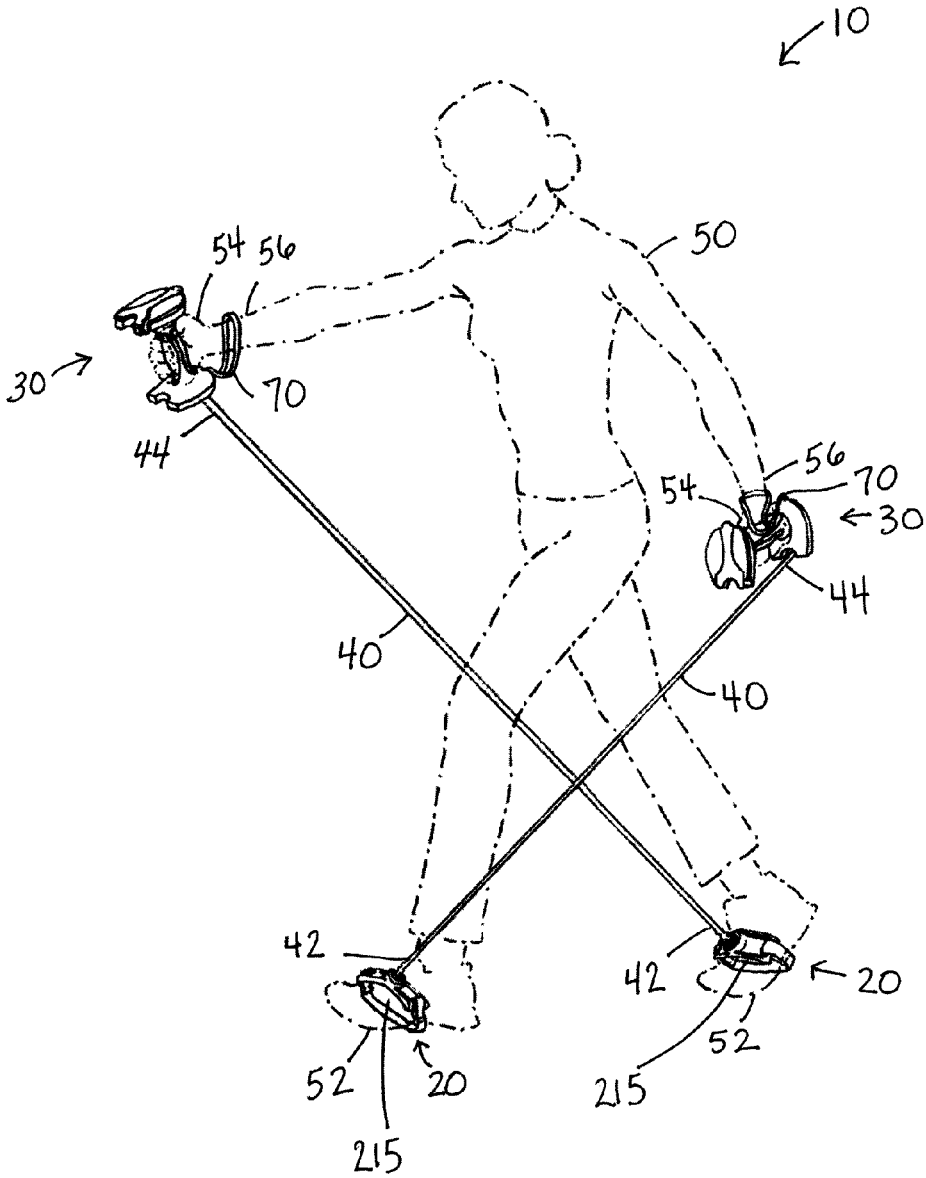
FIG. 1 shows a pair of an exemplary exercise device 10, with a stretching elastic member 40 separating a hand grip 30 and a foot cuff 20, being used by a user 50 while walking.

Returning to FIG. 1, the exercise device 10 allows the user 50 to enhance his or her workout routine while walking or jogging using the resistance provided by the elastic member 40 and the additional weight of the hand grip 30 and the foot cuff 20. Specifically, because the elastic member 40 resists being stretched, the user 50 expends additional energy stretching the elastic member 40 between the hand grip 30 and the foot cuff 20 with each step. A lanyard 70 is secured to the hand grip bottom side 310, as further discussed below, and the user's wrist or arm 56 can be inserted through the loop of the lanyard 70 (and/or the lanyard 70 may be wrapped around the user's wrist or arm 56) so that the hand grip 30 does not drop to the floor if the user 50 releases his or her grip of the hand grip 30.

Figure 2A:
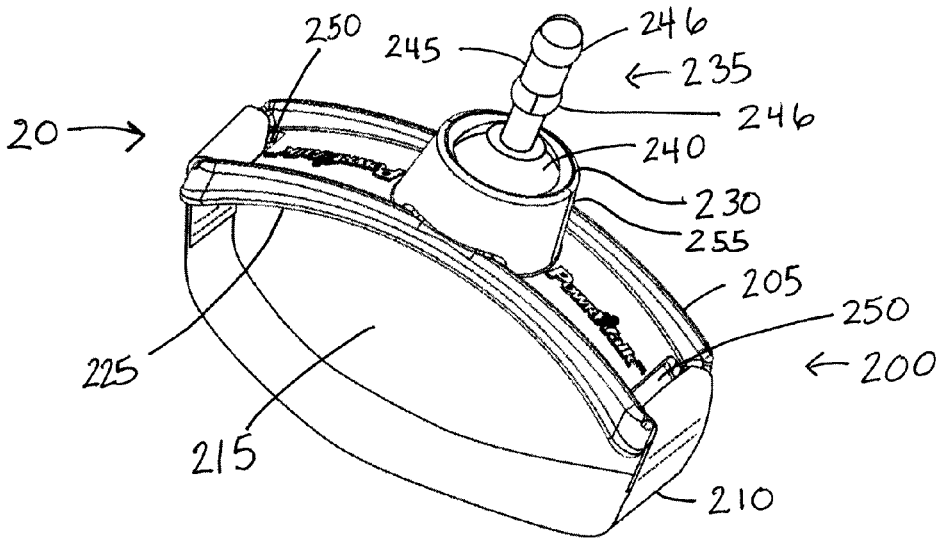
FIG. 2A shows an exemplary foot cuff 20 with a foot passage 215 sized to fit a user's foot 52, and a foot cuff pivot 235 extending from a foot cuff body passage 220 (see FIG. 2B) formed in a rigid foot cuff section 205.

Referring to FIG. 2A, the foot cuff 20 includes the bowed rigid foot cuff section 205, and a strap forming the flexible foot cuff section 210. The rigid foot cuff section 205 is curved so that the foot cuff body inner side 225 better conforms to the shape of the user's foot 52. The foot cuff 20 includes two foot cuff slots 250 on opposing sides of the rigid foot cuff section 205. Opposing ends of the strap 210 are looped through the foot cuff slots 250 and can be sewn onto the strap 210 to secure the strap 210 to the rigid foot cuff section 205. The strap preferably has a length that allows the foot cuff 20 to define a foot cuff body passage 220 (see FIG. 2B) sized to receive the user's foot 52 (or shoe 52) therethrough. The foot cuff body passage 220 extends through a tapered cylinder 255 extending upwards from the rigid foot cuff section 205. The pivot plug 245 of the foot cuff pivot 235 (and a portion of the pivot enlarged portion 240) is able to enter the foot cuff body passage 220 from below and pass through the foot cuff body passage 220, but the pivot enlarged portion 240 is not able to pass through the foot cuff body passage 220 due to the tapering of the tapered cylinder 255.

Figure 2B:
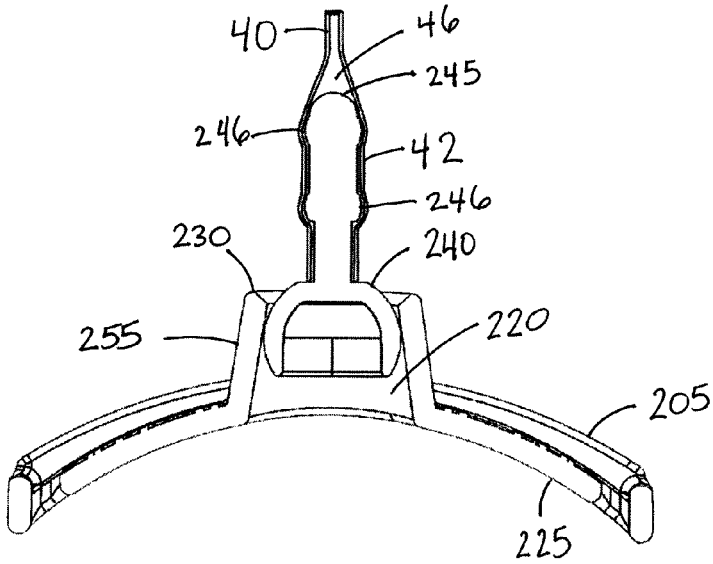
FIG. 2B shows a cross-section of the foot cuff 20 of FIG. 2A, with the elastic member 40 extending from a pivot plug 245 of the foot cuff pivot 235, and with the pivot plug 245 installed in an elastic member socket 46 of the elastic member 40. Only a portion of the elastic member 40 is shown, with the remainder that would be extending upwards not shown in this drawing.

Although the pivot plug 245 is shown to extend perpendicularly from the rigid foot cuff section 205 in FIGS. 2A and 2B, the foot cuff pivot 235 is able to rotate and pivot with respect to the foot cuff 20, allowing the pivot plug 245 to point in different directions (see, e.g., FIG. 1). The foot cuff pivot 235 can be pivoted so that the pivot plug 245 points in any direction (i.e., until the pivot plug 245 makes contact with the tapered cylinder 255). In FIG. 2B, the pivot plug 245 is inserted in the elastic member socket 46 at the elastic member first end 42 by radially stretching the elastic member 40 outward. A pair of pivot plug bulges 246 help resist unwanted withdrawal of the pivot plug 245 from the elastic member socket 46. The ability of the pivot plug 245 to pivot as the elastic member 40 is being pulled in different directions helps minimize the stresses imposed on the elastic member 40 by the pivot plug 245 in the elastic member socket 46, helping extend the life of the elastic member 40. If the pivot enlarged portion 240 were not able to pivot, and the pivot plug 245 thus pointed in only one direction, the elastic member 40 being pulled in a different direction would press the pivot plug 245 against the inside edge of the elastic member socket 46, substantially increasing wear and tear.

Figure 3:
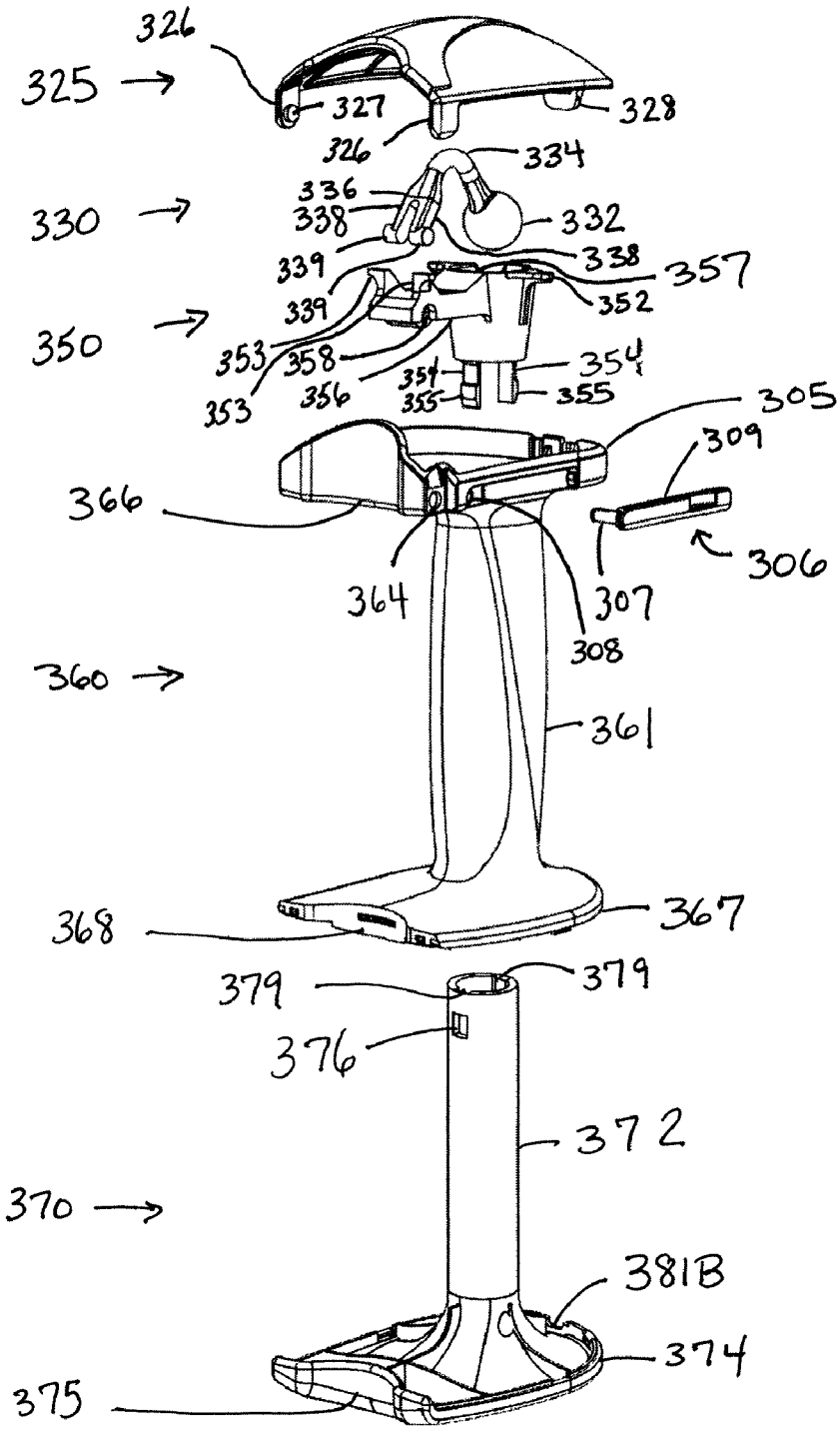
FIG. 3 shows an exploded view of the hand grip 30 of FIG. 1 with an optional hanging lever 306.

Referring to FIG. 3, the hand grip 30 can be disassembled into the lid 325, the impinger 330, a chamber well 350, a hand grip body 360, and an end cap 370 370. These components are assembled into the hand grip 30 shown in FIGS. 4 and 5. It is noted that the hand grip 30 of FIG. 3 also includes an optional hanging lever 306 (see discussion below) not included in the hand grip of FIG. 5. Starting at the top, the lid 325 covers the chamber 320 when closed, and allows access to the chamber 320, the impinger 330, and the elastic member 40 when open. The lid 325 is domed to provide additional space in the chamber 320. The lid 325 includes a pair of lid legs 326, each with a lid tab 327 extending therefrom. To install the lid 325 on the hand grip top side 305 of the hand grip body 360, the lid tabs 327 are inserted into a pair of lid sockets 364 in the hand grip top side 305 of the hand grip body 360. Once installed, the lid 325 is able to swing open and reclose as desired. The lid 325 also includes a lid lip 328, which is able to engage the chamber 320 lip to reversibly lock the lid 325 in the closed position.

The impinger 330 includes an impinger head 332 and an impinger torso 336 separated by an impinger neck 334. The impinger head 332 has a spherical shape, and a bend in the impinger neck 334 provides the impinger 330 with a roughly parabolic shape. The impinger torso 336 includes a pair of flexible impinger legs 338, each terminating in an impinger knob 339 that is sized to be received in a well socket 358. To install the impinger 330 in the chamber well 350, the impinger 330 legs are squeezed together slightly to fit between a pair of forward wings 353 in the well (see below), the impinger knobs 339 positioned at the well socket 358, and the impinger 330 legs released to permit the impinger knobs 339 to enter the well socket 358. Once installed, the impinger 330 is able to swing with respect to the impinger knobs 339, allowing the impinger head 332 to enter and exit the chamber well 350. To disengage the impinger 330, the user 50 can pull on the impinger 330 (such as the impinger neck 334) and swing the impinger 330 in an upwardly direction. To engage the impinger 330 (the impinger 330 is shown in the engaged position in FIGS. 4 and 5), the user 50 can press down on the impinger 330 (such as the impinger neck 334 or the impinger head 332) to insert the impinger head 332 into a well passage 351 (see FIG. 4) and press against any elastic member 40 extending from the hand grip channel 315 into the chamber 320. To enhance the hold of the impinger 330 on the elastic member 40 (and to minimize slippage of the elastic member back through the channel 315), the user 50 preferably holds the elastic member second end 44 with one hand, pulls down on a portion of the elastic member 44 entering the channel 315 from below the hand grip bottom side 310, and lowers the impinger 330 as the elastic member 40 is stretched. It is noted that the chamber 320 is formed in part in the hand grip top side 305, and the channel 315 extends through a handle 361 (see below) and the well passage 351, opening into the chamber 320.

Figure 4:
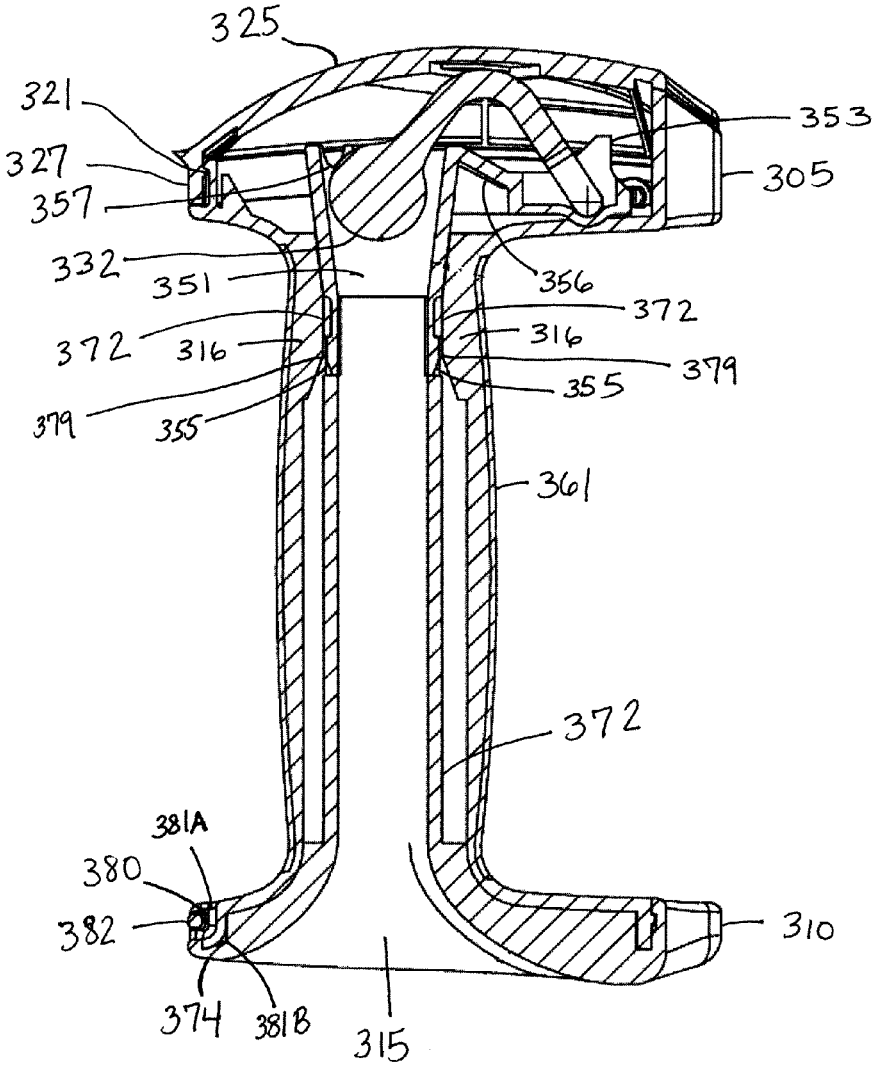
FIG. 4 shows a cutting-plane cross-section of the hand grip 30 of FIG. 1.

The tapered well passage 351 is inserted into the hand grip channel 315, providing a continuous hand grip channel 315 extending from the hand grip top side 305 to the hand grip bottom side 310. A set of fins 316 (see FIGS. 4 and 5) extends radially into the channel 315 of the hand grip body 360. The fins 316 help center the chamber well 350 when the well passage 351 is inserted into the hand grip channel 315. The pair of forward wings 353 and a pair of rear wings 352, the rear and forward wings 352, 353 separated by a well neck 356, help secure an elastic member 40 wrapped around the well in the chamber 320 (see FIG. 4). The elastic member 40 extending up from the well passage 351 can wrap around the well by continuing beneath one of the rear wings 352 via one of a pair of semi-circular well depressions 357 (see FIG. 5, in which one of the well depressions 357 is viewable, and the other well depression 357 is covered by the elastic member 40). The well depressions 357 help better accommodate the elastic member 40 as the elastic member 40 snakes around the chamber well 350 for stowing in the chamber 320. The chamber well 350 includes a pair of flexible well prongs 354, each well prong 354 having a prong tab 355. The prong tabs 355 are sized to snap into a pair of stem windows 376 formed in a stem 372 of the end cap 370, helping secure the chamber well 350 and the end cap stem 372 together when the hand grip 30 is assembled. As can be seen in FIGS. 3 and 4, the inside of the stem 372 includes a pair of stem grooves 379. The stem grooves 379 are depressions sized to receive the well prongs 354 therein (that is, the thickness of the well prongs 354 are substantially equal to the depth of the grooves 372). As shown in FIG. 4, stem grooves 379 allow the diameter of the hand grip channel 315 to remain substantially constant through the stem 372 without narrowing even with the well prongs 354 inserted into the stem 372.

The hand grip body 360 includes the hand grip top side 305 and a hand grip body base 367 separated by the handle 361. The hand grip top side 305 has a top body depression 366, and the hand grip body base 367 and an end cap base 374 have hand grip body depression 368 and end cap base depression 375, respectively. The depressions 366, 368, 375 help accommodate the elastic member 40 as the exercise device 10 is moved about (letting the elastic member 40 nest within the depressions 366, 368, 375 as, e.g., the user 50 swings his or arm backwards). In FIG. 1, for example, the hand grip 30 in the user's left hand 54 is turned around such that the hand grip top side 305 is approximately pointed in the direction of the foot cuff 20. Here, the elastic member 40 fits in depressions 368, 375 in the hand grip bottom side 310, allowing the user 50 to move more freely by reducing interference resulting from the hand grip 30 itself.

Returning to FIG. 3, the hanging lever 306 includes a hanging lever 306 pin 307 extending perpendicularly from a lever body 309. The hanging lever 306 can be hingedly secured to the hand grip top side 305 by inserting the lever pin 307 into a lever socket 308. The hanging lever 306 is in a stowed position when it is substantially parallel to primary axis of the hand grip top side 305. To engage the hanging lever 306, the hanging lever 306 can be swung down such that it makes, e.g., about a ninety-degree angle with the primary axis of the hand grip top side 305. The hanging lever 306 can help secure or otherwise stow the hang grip when not being used by, for example, inserting the hanging lever 306 into a pocket in the user's 50 clothing to free-up the user's hands 54.

Figure 5:
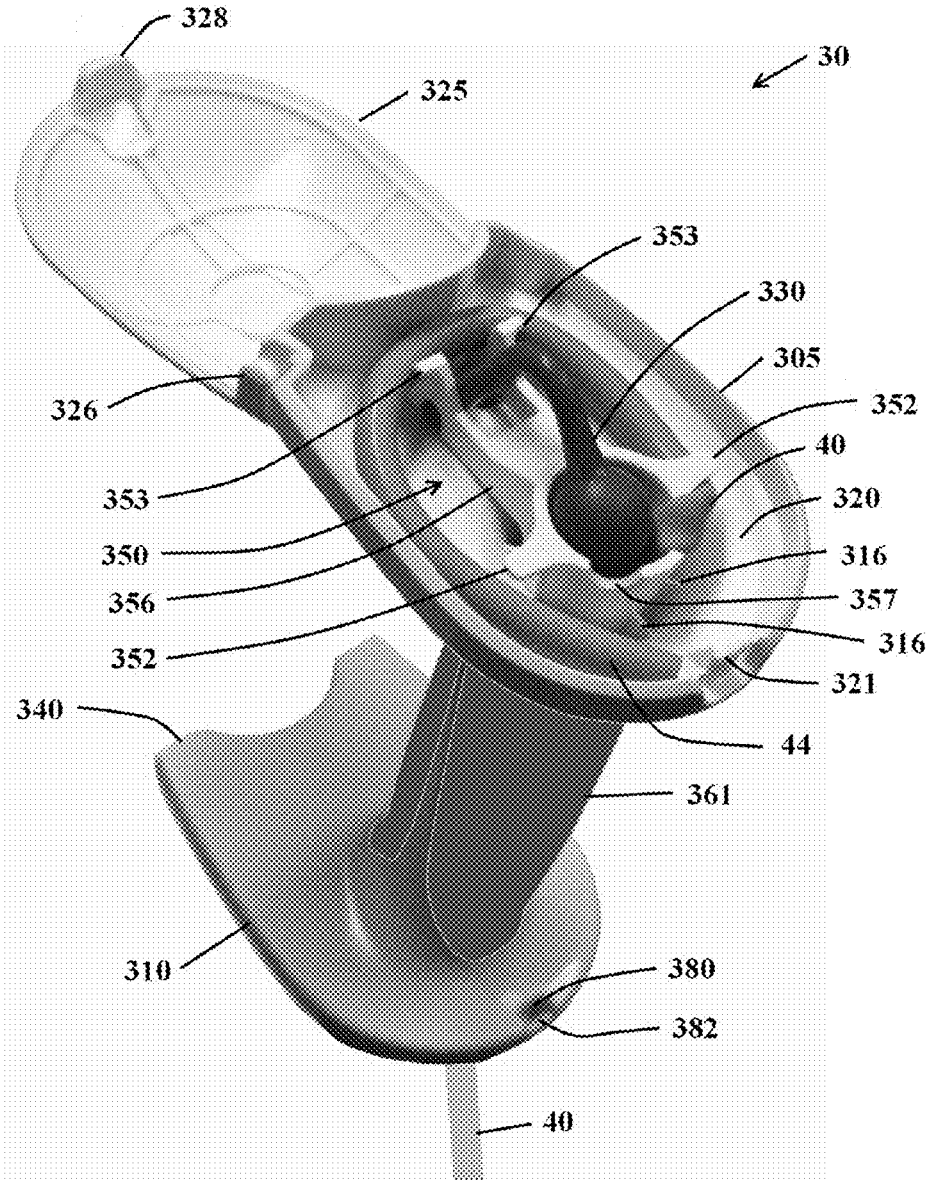
FIG. 5 shows the hand grip 30 of FIG. 1, with a lid 325 in an open position, the elastic member 40 stowed in a hand grip chamber 320, and an impinger 330 in an engaged position. The hand grip 30 of FIG. 5 does not include the hanging lever 306 of FIG. 3.

The end cap 370 includes the stem 372 extending from the end cap base 374. To assemble the hand grip 30, the end cap stem 372 is inserted through the channel 315 of the hand grip body 360 and engaged with the well prongs 354 of the chamber well 350. The end cap base 374 includes the end cap base depression 375 corresponding with the hand grip body base depression 368 for accommodating an elastic member 40. The end cap base 374 also helps provide strength to the hand grip body base 367 when the hand grip 30 is used to support the user's 50 weight while performing push-up exercises. As can be seen in FIGS. 3-5, a lanyard aperture 381A in the hand grip body base 367, and a lanyard depression 381B in the end cap base 374, together define a lanyard valley 380. A lanyard pin 382 formed in the hand grip body base 367 extends across the lanyard valley 380, permitting a lanyard 70, for example, to be secured to the hand grip 30 by looping about the lanyard pin 382.

Figure 6A:
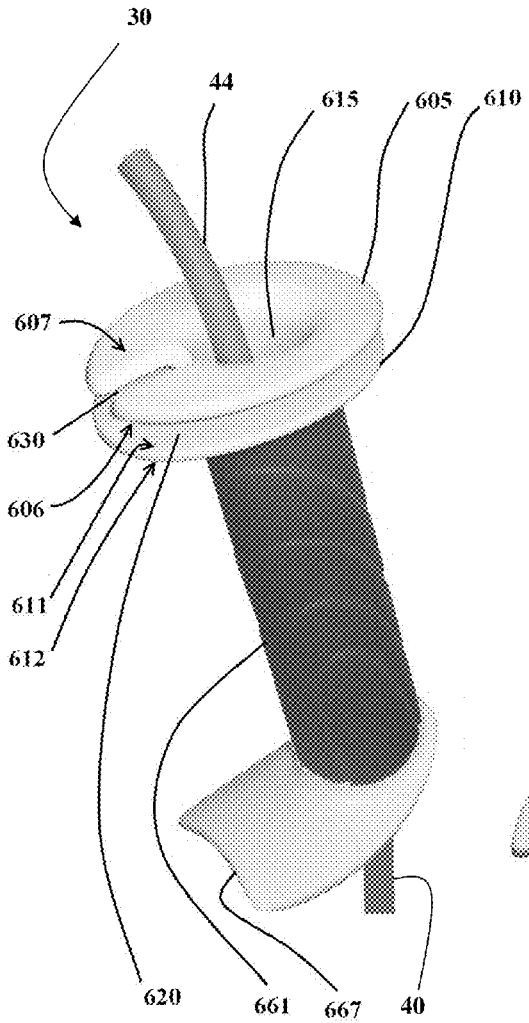
FIG. 6A shows an alternative hand grip 30 having upper and lower flanges 605, 610 extending radially around the circumference of the hand grip 30, with an elastic member 40 extending through a hand grip channel 615.
Figure 6B:
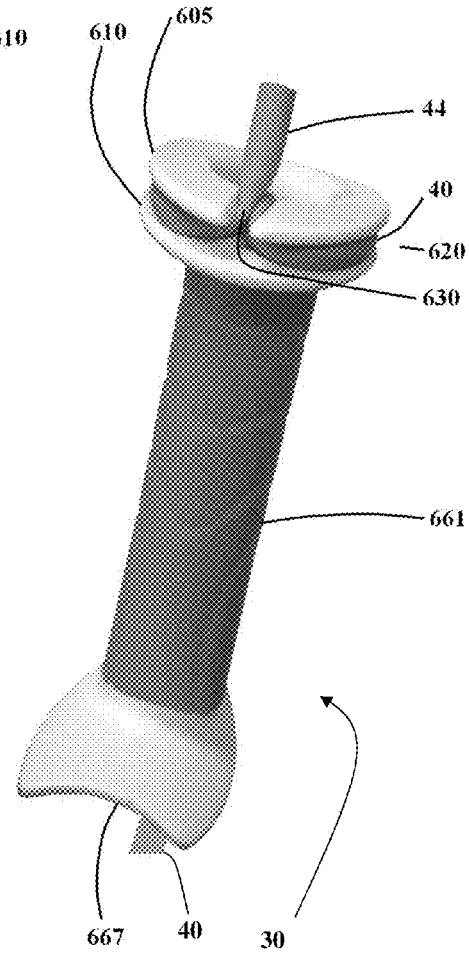
FIG. 6B shows the hand grip 30 of FIG. 6A with an elastic member 40 installed in a hand grip valley 620 defined between the upper and lower flanges 605, 610.

In the alternative exemplary version shown in FIGS. 6A and 6B, the elastic member 40 is inserted through a channel 615 formed through a handle 661. The hand grip base 367 includes an analogous base depression 667 for accommodating the elastic member 40 as the hand grip 30 is used. Rather than stowing an unused portion of an elastic member 40 in a chamber 320, the elastic member 40 extending through the channel 615 enters the valley 620, which is defined between the upper and lower flanges 605, 610, via a groove 630 in the upper flange 605. Once the elastic member 40 has been wrapped around hand grip 30 within the valley 620, the end of the elastic member 40 is again extended into the groove 630 and held in place by being pressed between a portion of the elastic member 40 and the upper flange 605. The elastic member 40 being held in place can be unsecured by pulling the elastic member second end 44 out of the groove 630 and unwrapping the elastic member 40. This hand grip 30, and the one in FIG. 5, both allow for convenient stowing and easy replacement as elastic member 40 of varying resistances and lengths are desired.

It should also be understood that various terms referring to orientation and position are used throughout this document—e.g., "top" (as in "hand grip top side 305") and "bottom" (as in "hand grip bottom side 310")—are relative terms rather than absolute ones. In other words, it should be understood (for example) that the hand grip bottom side 310 being referred to may in fact be located at the top of the apparatus depending on the overall orientation of the apparatus. Thus, such terms should be regarded as words of convenience, rather than limiting terms. Also, it is to be understood that such terms as "forward," "rear," "upward," "down," and the like are words of convenience and are not to be construed as limiting terms.

Various preferred versions of the invention are shown and described above to illustrate different possible features of the invention and the varying ways in which these features may be combined. Apart from combining the different features of the foregoing versions in varying ways, other modifications are also considered to be within the scope of the invention. Following is an exemplary list of such modifications.

Although in FIG. 1, the elastic member second end 44 is secured to a hand grip 30, the elastic member second end 44 may instead be secured to the user's hand, wrist, arm, or upper body in any manner deemed suitable. For example, the pair of hand grips 30 can be replaced by a second pair of foot cuffs 20, and the user 50 may insert a hand 54 or wrist 56 through the foot passage 215 or otherwise grip the foot cuff 20 to stretch the elastic member 40.

Although in FIGS. 2A and 2B the foot cuff body 200 is shown with the rigid body section and the separate flexible foot cuff section 210, the foot cuff body 200 may be reconfigured, for example, to have only an extended rigid section defining the foot passage 215 without the flexible foot cuff section 210. Analogously, the rigid foot cuff section 205 (save a structure defining the foot cuff body passage 220) can be reconfigured to be flexible (e.g., made with fabric, elastic webbing incorporating rubber, etc.). Moreover, the tapered cylinder 255 may be shortened or eliminated, with the rigid foot cuff section 205 having an aperture sized to restrict passage by the pivot enlarged portion 240 while allowing the pivot plug 245 to pivot and point in various directions. Additionally, the pivot plug bulges 246 are not necessarily required for the pivot plug 245 to resist withdrawal from the elastic member socket 46. Enough resistance to withdrawal may be provided by the radial stretching of the elastic member 40 and the friction between the pivot plug 245 and the inside surface of the elastic member socket 46.

Referring to FIGS. 3-5, although the impinger head 332 is shown with an approximately spherical shape, the impinger head 332 pressing against the elastic member 40 to help secure the elastic member 40 to the hand grip 30 can have any shape or structure suited to restricting the movement of the elastic member 40. For example, the head may be cubical, pyramidal (preferably with the base of the pyramid pressing against the elastic member 40), or otherwise, and it may have an irregular outer surface to increase the friction with the elastic member 40. A spherical shape helps increase the surface area over which the impinger head 332 makes contact with the elastic member 40, pinching the elastic member evenly and helping minimize wear and tear on the elastic member 40. The diameter of the spherical impinger head 332 approaches the inner diameter of the chamber well 350 when the impinger head 332 is seated in the well 350.

The impinger 330 is shown to be secured to the hand grip 30 via the chamber well 350, but the impinger 330 may instead be secured directly to the hand grip 30. Moreover, features of the end cap 370 may be incorporated in the hand grip body 360, allowing the well prongs 354 to engage the hand grip body 360 directly rather than the end cap stem 372. Instead of, or in addition to, the rear and forward wings 352, 353, the hand grip top side 305 can include, for example, hooks in the chamber 320 to help keep the elastic member 40 within the chamber 320. Further, the chamber 320 may include a pair of flanges, with a valley sized to receive the elastic member 40 formed therebetween.

Although the hand grip bottom side 310 of the alternative version shown in FIGS. 6A and 6B is intended to help keep the elastic member 40 out of the user's way while the hand grip 30 is moved about, the bottom of the hand grip 30 (where the base depression 667 is located) may be strengthened to allow it to be used in push-up exercises as well, analogous to the version in FIGS. 3-5. Further, the protrusion 340 (see FIG. 5) and/or the protrusion in which base depression 667 is defined (see FIGS. 6A and 6B) at the bottom of the hand grip 30 can be eliminated. For example, the hand grip body base 367 and the end cap base 374 can be removed (see FIG. 3) from hand grip 30, such that the hand grip 30 terminates with handle 361.

It is noted that the exemplary exercise device and/or its parts discussed above, as well as variations thereof, may utilize features of, and/or be used with exercise devices and exercises discussed or referenced in, for example, the following references (among others): U.S. Pat. No. 7,044,896 to Hetrick: "Exercise device including adjustable, inelastic straps"; U.S. Pat. No. 7,090,622 to Hetrick: "Exercise device grips and accessories for exercise devices"; U.S. Pat. No. 7,651,448 to Hetrick: "Method of using an adjustable exercise device"; U.S. Pat. No. 7,722,508 to Hetrick: "Combination grip for an exercise device"; U.S. Patent Appln. Publication 2007/0027005 to Hetrick: "Exercise device grips and accessories for exercise devices"; U.S. Patent Appln. Publication 2007/0066450 to Hetrick: "Combination grip for an exercise device"; U.S. Patent Appln. Publication 2009/0075787 to Hetrick: "Exercise device having a door anchor"; U.S. Patent Appln. Publication 2009/0075788 to Hetrick: "Inelastic exercise device having a limited range"; U.S. Patent Appln. Publication 2009/0075789 to Hetrick: "Exercise device having inelastic straps and interchangeable parts"; U.S. Patent Appln. Publication 2009/0075790 to Hetrick: "Combination anchor for an exercise device"; U.S. Patent Appln. Publication 2009/0075794 to Hetrick: "Combination grip for an exercise device"; and U.S. Patent Appln. Publication 2009/0105053 to Hetrick: "Combination grip for an exercise device".

The invention is not intended to be limited to the preferred versions of the invention described above, but rather is intended to be limited only by the claims set out below. Thus, the invention encompasses all different versions that fall literally or equivalently within the scope of these claims.

What is claimed is:

1. An exercise device including a foot cuff having:

a) a foot cuff body with:

1) a foot cuff body inner side surrounding a foot passage;

2) a foot cuff body outer side opposite the foot cuff body inner side; and 3) a foot cuff body passage extending from the foot cuff body inner side to the foot cuff body outer side, the foot cuff passage having a passage central axis extending in a direction from the foot cuff body inner side to the foot cuff body outer side;

b) a foot cuff pivot configured to be pivotally fit in the foot cuff body passage, the foot cuff pivot being sized such that it cannot fit through the foot cuff body passage at the foot cuff body outer side, wherein:

1) the foot cuff pivot includes a pivot axis extending from a pivot first end to an opposing pivot second end; and 2) when the foot cuff pivot is pivotally fit in the foot cuff body passage, the foot cuff pivot is pivotable between:

(i) a first position in which the pivot axis is aligned with the passage central axis; and (ii) a second position in which the pivot axis is offset from the passage central axis by several degrees;

c) an elongated elastic member extending from the foot cuff pivot, the elastic member being secured to the foot cuff pivot, wherein at least a portion of the foot cuff pivot is situated outside of the elastic member.

2. The exercise device of claim 1 wherein:

a) the foot cuff pivot has a pivot enlarged portion and a pivot plug extending from the pivot enlarged portion;

b) the elastic member has an elastic member first end, and an elastic member second end opposite the elastic member first end;

c) the elastic member first end includes an elastic member socket defined therein; and d) the elastic member first end is secured to the foot cuff pivot, wherein:

1) at least a majority of the pivot plug is situated within the elastic member socket; and 2) at least a majority of the pivot enlarged portion is situated outside of the elastic member socket.

3. The exercise device of claim 1 wherein:

a) a rigid foot cuff section defines a first portion of the foot cuff body, the rigid foot cuff section having the foot cuff body passage defined therein;

b) a flexible foot cuff section defines a second portion of the foot cuff body; and c) the rigid foot cuff section and flexible foot cuff section surround at least a substantial portion of the foot passage.

4. The exercise device of claim 1:

a) wherein the elastic member extends from an elastic member first end at the foot cuff pivot to an opposing elastic member second end; and b) further including a hand grip having a hand grip channel therein, wherein the elastic member second end extends into the hand grip channel, with the elastic member being removably secured to the hand grip.

5. The exercise device of claim 4 wherein the hand grip further includes:

a) a chamber sized to stow at least a portion of the elastic member; and b) a lid covering the chamber, the lid being movable to open and close the chamber.

6. The exercise device of claim 4 wherein the hand grip further includes an impinger rotatably secured thereto, the impinger configured to rotate between:

a) an engaged position in which the impinger at least partially enters the hand grip channel to impinge on the elastic member extending through the hand grip channel; and b) a disengaged position in which impinger does not enter the hand grip channel.

7. A method of using the exercise device of claim 6 including the steps of:

a) inserting a foot through the foot passage;

b) holding the hand grip with a hand;

c) moving the lid to open the chamber and rotating the impinger to the disengaged position;

d) adjusting the position of the elastic member within the hand grip channel to a desired position;

e) rotating the impinger to an engaged position to lock the elastic member in the desired position, and moving the lid to close the chamber; and f) stretching the elastic member between the foot and the hand.

8. An exercise device including:

a) a foot cuff having:

1) a foot cuff body with:

(i) a foot cuff body inner side surrounding a foot passage;

(ii) a foot cuff body outer side opposite the foot cuff body inner side; and (iii) a foot cuff body passage extending from the foot cuff body inner side to the foot cuff body outer side;

2) a foot cuff pivot pivotally fit in the foot cuff body passage, the foot cuff pivot being sized such that it cannot fit through the foot cuff body passage at the foot cuff body outer side; and b) a hand grip having:

1) a hand grip channel therein;

2) an upper flange extending from the hand grip, the upper flange:

(i) circumferentially orbiting at least a major portion of the hand grip channel; and (ii) having an upper flange inner surface, and an upper flange outer surface opposite the upper flange inner surface;

3) a lower flange extending from the hand grip and spaced from the upper flange, the lower flange:
(i) circumferentially orbiting at least a major portion of the hand grip channel; and
(ii) having a lower flange inner surface, and a lower flange outer surface opposite the lower flange inner surface; and
4) a valley between the upper flange inner surface and the lower flange inner surface, the valley circumferentially orbiting at least a major portion of the hand grip; and
c) an elongated elastic member extending from an elastic member first end to an opposing elastic member second end, wherein:
1) the elastic member first end is secured to the foot cuff pivot; and
2) the elastic member second end extends into the hand grip channel, with the elastic member being removably secured to the hand grip.

9. The exercise device of claim 8 further including a groove that is sized to receive the elastic member therein,
a) the groove being formed in at least one of:
1) the upper flange, the groove extending between the upper flange outer surface and the upper flange inner surface; and
2) the lower flange, the groove extending between the lower flange inner surface and the lower flange outer surface;
b) wherein the groove opens onto the valley.

10. A method of using the exercise device of claim 9 including the steps of:
a) inserting a foot through the foot passage;
b) holding the hand grip with a hand;
c) adjusting the position of the elastic member within the hand grip channel to a desired position;
d) wrapping a first portion of the elastic member around the hand grip channel within the valley;
e) inserting a stretched second portion of the elastic member into the groove and unstretching the elastic member to lock the elastic member within the groove; and
f) stretching the elastic member between the foot and the hand.

11. The exercise device of claim 9 wherein:
a) the hand grip has a length extending between a hand grip top side and an opposing hand grip bottom side;
b) the hand grip channel extends from the hand grip top side to the hand grip bottom side;
c) the upper flange and the lower flange are situated about the hand grip top side; and
d) a bottom side protrusion extends outwardly in radial direction from the hand grip bottom side along an axis aligned with the upper flange.

12. An exercise device including:
a) a foot cuff having:
1) a foot cuff body having:
(i) a foot cuff body inner side defining a foot passage;
(ii) a foot cuff body outer side opposite the foot cuff body inner side;
(iii) a foot cuff body passage extending between the foot cuff body inner side and the foot cuff body outer side; and
2) a foot cuff pivot with a pivot plug extending from a pivot enlarged portion, the pivot plug being narrower than the pivot enlarged portion, the pivot enlarged portion:
(i) being sized such that it cannot fit through the foot cuff body passage at the foot cuff body outer side;
(ii) being at least partially situated within the foot cuff body passage; and
(iii) being pivotally fit in the foot cuff body passage;
b) a hand grip; and
c) an elastic member having:
1) an elastic member first end with an elastic member socket defined therein, the elastic member first end being secured to the foot cuff by having the pivot plug inserted into the elastic member socket, wherein at least a majority of the pivot enlarged portion is not positioned within the elastic member socket; and
2) an elastic member second end opposite the elastic member first end, the elastic member second end being secured to the hand grip.

13. The exercise device of claim 12 wherein:
a) the foot cuff body includes:
1) a rigid foot cuff section defining a first portion of the foot cuff body inner side and the foot cuff body outer side; and
2) a flexible foot cuff section defining a second portion of the foot cuff body inner side and the foot cuff body outer side; and
b) the rigid foot cuff section and flexible foot cuff section surround at least a substantial portion of the foot passage.

14. The exercise device of claim 12, the hand grip further including:
a) a length extending between a hand grip top side and an opposing hand grip bottom side;
b) a hand grip channel extending along the length of the hand grip, with the elastic member extending through the hand grip channel;
c) an upper flange extending radially outward from the hand grip top side, the upper flange:
1) circumferentially orbiting at least a major portion of the hand grip channel; and
2) having an upper flange inner surface facing the hand grip bottom side, and an opposing upper flange outer surface facing the hand grip top side;
d) a lower flange spaced from the upper flange, the lower flange extending radially outward from the hand grip top side, the lower flange:
1) circumferentially orbiting at least a major portion of the hand grip channel, the lower flange being at least substantially parallel to the upper flange about the circumference of the hand grip channel; and
2) having a lower flange inner surface facing the hand grip top side, and an opposing lower flange outer surface facing the hand grip bottom side;
e) a valley defined by the space between the upper flange and the lower flange, the valley sized such that at least a portion of the elastic member fits therebetween; and
f) a bottom side protrusion extending radially outward from the hand grip bottom side.

15. An exercise device including:
a) a foot cuff having:
1) a foot cuff body having:
(i) a foot cuff body inner side defining a foot passage;
(ii) foot cuff body outer side opposite the foot cuff body inner side;
(iii) a foot cuff body passage extending between the foot cuff body inner side and the foot cuff body outer side; and 2) a foot cuff pivot with a pivot plug extending from a pivot enlarged portion, the pivot enlarged portion being:
(i) pivotally fit in the foot cuff body passage;
(ii) sized such that it cannot fit through the foot cuff body passage at the foot cuff body outer side; and
(ii) at least partially situated within the foot cuff body passage;

b) an elastic member having an elastic member first end opposing an elastic member second end, wherein:
1) the elastic member first end includes an elastic member socket defined therein; and
2) the pivot plug is situated at least partially within the elastic member socket; and c) a hand grip having:
1) a hand grip top side and an opposing hand grip bottom side;
2) a hand grip channel extending along the length of the hand grip from the hand grip top side to the hand grip bottom side, the elastic member second end extending through the hand grip channel and being secured to the hand grip;
3) a chamber sized to stow at least a portion of the elastic member; and
4) a closable lid covering the chamber, the stowed portion of the elastic member being secured within the chamber when the lid is closed.

16. The exercise device of claim 15 further including an impinger configured to secure the elastic member second end to the hand grip by pressing the elastic member against the hand grip channel.

17. The exercise device of claim 14 further including a groove that is configured to receive the elastic member therein while restricting the movement of the elastic member therethrough, a) the groove being in at least one of:
1) the upper flange, the groove extending between the upper flange outer surface and the upper flange inner surface; and
2) the lower flange, the groove extending between the lower flange inner surface to the lower flange outer surface;

b) wherein the groove opens onto the valley.

18. An exercise device:

a) the exercise device including:
1) a foot cuff having:
(i) a foot passage sized to receive a foot therethrough; and
(ii) a foot cuff body including:
(a) a foot cuff body inner side defining the foot passage, and a foot cuff body outer side opposite the foot cuff body inner side;
(b) a foot cuff body passage extending between the foot cuff body inner side and the foot cuff body outer side; and
(c) a foot cuff pivot pivotally fit in the foot cuff passage such that the foot cuff pivot pivots with respect to the foot cuff body;
2) an elastic member having an elastic member first end secured to the foot cuff pivot, and an elastic member second end opposite the elastic member first end;
3) an elongated hand grip having:
(i) a length extending between a hand grip top side and an opposing hand grip bottom side; and
(ii) a hand grip channel extending through the hand grip from the hand grip top side to the hand grip bottom side, wherein the elastic member extends through the hand grip channel;

b) wherein the elastic member second end is removably secured to the hand grip.

19. The exercise device of claim 18 wherein the hand grip further includes:

a) a chamber sized to stow at least a portion of the elastic member, the chamber being situated to receive the elastic member from the hand grip channel;
b) a closable lid covering the chamber, the lid being situated over the hand grip top side; and
c) an impinger configured to impinge on the elastic member extending through the hand grip channel to secure the elastic member to the hand grip.

20. The exercise device of claim 18 wherein the hand grip further includes:

a) an upper flange and a lower flange spaced therefrom, the upper and lower flanges:
1) extending radially outward from the hand grip and being at least substantially parallel to each other; and
2) defining a valley therebetween, the valley being sized to fit at least a portion of an elastic member being wrapped about the hand grip; and b) a groove opening onto the valley, the groove:
1) being sized to receive the elastic member therein; and
2) being formed in one or both of the upper and lower flanges.

21. The exercise device of claim 18 wherein the hand grip further includes a bottom side protrusion extending radially outward from the hand grip bottom side along an axis that is at least substantially perpendicular to the hand grip length.

22. The exercise device of claim 18 wherein:

a) the foot cuff pivot further includes a pivot enlarged portion sized such that it cannot fit through the foot cuff passage at the foot cuff body outer side, and a foot cuff plug extending from the pivot enlarged portion;
b) the pivot enlarged portion is at least partially situated within the foot cuff body passage, and the foot cuff plug extends toward the hand grip;
c) the elastic member first end includes an elastic member socket defined therein; and
d) the elastic member first end is secured to the foot cuff pivot, with the pivot plug fit within the elastic member socket.

23. The exercise device of claim 22 wherein:

a) a rigid foot cuff section defines a first portion of the foot cuff body, and a flexible foot cuff section defines a second portion of the foot cuff body, the rigid and flexible foot cuff sections surrounding at least a substantial portion of the foot passage; and
b) the foot cuff body passage is defined in the rigid foot cuff section.

24. An exercise device including a foot cuff having:

a) a foot cuff body with:
1) a foot cuff body inner side surrounding a foot passage, and a foot cuff body outer side opposing the foot cuff body inner side; and
2) a foot cuff body passage extending from the foot cuff body inner side to the foot cuff body outer side;

b) a foot cuff pivot having a pivot plug extending from a pivot enlarged portion,
(i) the pivot plug being narrower than the pivot enlarged portion,
(ii) the pivot enlarged portion being pivotally fit in the foot cuff body passage; and c) an elastic member having an elastic member first end with an elastic member socket defined therein, the elastic member socket being configured to snugly receive the pivot plug therein, wherein the pivot plug is inserted into the elastic member socket and at least a majority of the pivot enlarged portion is not positioned within the elastic member socket.

25. The exercise device of claim 24 wherein the pivot plug is inserted in the elastic member socket to secure the elastic member to the foot cuff pivot.

26. The exercise device of claim 25 wherein when the elastic member is pulled upwardly away from the foot passage:

a) the pivot enlarged portion abuts the foot cuff body, with at least a majority of the pivot enlarged portion remaining within the foot cuff body passage; and b) the pivot plug extends outwardly from the foot cuff body passage away from the foot passage.

27. The exercise device of claim 24 wherein:

a) the foot cuff body passage includes a narrower body passage portion configured to prevent the pivot enlarged portion from passing through the foot cuff body passage in a direction away from the foot cuff body inner side and toward the foot cuff body outer side; and b) the pivot enlarged portion abuts the narrower body passage portion when the pivot enlarged portion is pivoting with respect to the foot cuff body.

28. An exercise device including a foot cuff having:

a) a foot cuff body with:

1) a foot cuff body inner side surrounding a foot passage, and a foot cuff body outer side opposing the foot cuff body inner side; and 2) a foot cuff body passage extending from the foot cuff body inner side to the foot cuff body outer side;

b) a foot cuff pivot pivotally fit in the foot cuff body passage, the foot cuff body passage being configured to:

1) permit the foot cuff pivot to enter the foot cuff body passage from the foot passage towards the foot cuff outer side; and 2) prohibit the foot cuff pivot from exiting the foot cuff body passage past the foot cuff outer side; and c) an elongated elastic member secured to the foot cuff pivot, wherein:

1) the foot cuff pivot has a range of pivotal motion across which it pivots with respect to the foot cuff body; and 2) the elastic member is not positioned between the foot cuff pivot and the foot cuff body across at least a majority of the range of pivotal motion of the foot cuff pivot.

29. The exercise device of claim 28 wherein:

a) the foot cuff pivot includes a pivot plug extending from an at least substantially spherical pivot enlarged portion;

b) the elastic member includes a first end having an elastic member socket defined therein;

c) at least a majority of the pivot plug is snugly fit within the elastic member socket; and d) at least a majority of the pivot enlarged portion is situated outside of the elastic member socket.

* * * * *